US005154506A

United States Patent [19]

Leard

[11] Patent Number: 5,154,506

[45] Date of Patent: Oct. 13, 1992

[54] FLASHLIGHT ARMBAND

[76] Inventor: Ronald R. Leard, 1070 Buena Vista Way, Carlsbad, Calif. 92008

[21] Appl. No.: 716,239

[22] Filed: Jun. 17, 1991

[51] Int. Cl.[5] ..... F21L 15/02

[52] U.S. Cl. ..... 362/103; 362/104; 362/108

[58] Field of Search ..... 362/103, 104, 105, 108, 362/190, 191, 806

[56] References Cited

U.S. PATENT DOCUMENTS

| | | | |
|---|---|---|---|
| 1,217,666 | 2/1917 | Thulin | 362/103 |
| 1,457,023 | 5/1923 | Fergusson | 362/103 |
| 1,594,510 | 8/1926 | Saks | 362/103 |
| 2,893,379 | 7/1959 | Springer | 362/105 |
| 3,215,453 | 11/1965 | Malcom, Jr. | 362/103 |
| 4,887,194 | 12/1989 | Fields | 362/191 |
| 4,897,768 | 1/1990 | Thul | 362/191 |
| 4,970,631 | 11/1990 | Marshall | 362/105 |
| 5,034,862 | 7/1991 | Liston | 362/105 |

FOREIGN PATENT DOCUMENTS

| | | | |
|---|---|---|---|
| 1282828 | 12/1961 | France | 362/103 |
| 688564 | 3/1965 | Italy | 362/103 |

*Primary Examiner*—Ira S. Lazarus
*Assistant Examiner*—Y. Quach

[57] ABSTRACT

A flashlight holder comprising an adjustable elastic strap with a smaller integral sleeve having an axis substantially parallel to that of a larger loop defined by the strap. The strap encircles the arm and mounts a flashlight either tucked inside the main arm strap, or within the smaller sleeve in the case of a smaller distance flashlight.

4 Claims, 1 Drawing Sheet

FLASHLIGHT ARMBAND

BACKGROUND OF THE INVENTION

The invention is in the field of flashlight retaining devices, and particularly those that retain flashlights to the forearm or other body part of the user.

Anyone who has worked on anything in the dark has encountered the problem of wishing he or she had three hands, so that one hand could hold the flashlight. Often, the person puts the butt end of the flashlight in his or her mouth to free the hands to work on the engine, the wiring, the fuse box, etc., in the dark. Because this is a common problem and no one yet has come up with a way of generating three hands, a number of prior art devices have been conceived to solve this problem. The following mechanical clip gadgets have been invented which use some kind of clip to engage the flashlight:

U.S. Pat. No. 1,200,403 issued Oct. 3, 1916 on a HOLDER FOR ELECTRIC FLASHLIGHTS;

U.S. Pat. No. 1,268,622 issued Jun. 4, 1918 for a SEARCH LIGHT HOLDER;

U.S. Pat. No. 1,318,850 issued Oct. 14, 1919 on an ELECTRIC FLASHLIGHT HOLDER;

U.S. Pat. No. 1,320,934 issued Nov. 14, 1919 for a FLASH LIGHT ATTACHMENT;

U.S. Pat. No. 1,769,241 issued Jul. 1, 1930 for a WRIST ATTACHMENT FOR FLASHLIGHTS;

U.S. Pat. No. 1,923,962 issued Aug. 22, 1933 for a FLASH LIGHT;

U.S. Pat. No. 2,024,281 issued Dec. 17, 1935 for a LIGHT.

These devices are characterized by having metal clips and are thus conductive and less flexible in adapting to different-sized flashlights than would be needed to accommodate the variety of flashlight sizes that are in common use today. Conductive clips are of course a major hazard when working in a fuse box or otherwise working or wiring, which is a typical activity that is done when no lights are on and in the hope that the main circuit breaker is open.

Three other patents disclose combination flashlights and wrist straps developed to solve the same problem. These are the following:

U.S. Pat. No. 3,112,889 issued Dec. 3, 1963 for a WRIST SUPPORTED FLASHLIGHT;

U.S. Pat. No. 4,425,600 issued Jan. 10, 1984 on an ELECTROLUMINESCENT WRIST CLAMP FOR NIGHT VISION ENVIRONMENT;

U.S. Pat. No. 4,788,631 issued Nov. 29, 1988 for a WRIST MOUNTED FLASHLIGHT.

Although these devices could be adequate for specialized purposes, they nonetheless are not adaptable for use with different kinds of flashlights and flashlights that the user might have around the premises in which he or she might favor using in particular circumstances.

There is a need for a modern retainer device, taking advantage of the qualities of modern materials and especially elastic fabrics, which is adaptable to engage virtually any flashlight to the forearm or wrist and which is relatively inexpensive to manufacture and is fabricated with a minimal number of conductive parts.

SUMMARY OF THE INVENTION

The instant invention fulfills the above stated need and provides a retainer strap for flashlights which is made out of a tough, but resilient strap of adjustable length which engages on the forearm, wrist or upper arm, or any other member for that matter, and will hold a flashlight securely in place. A small sleeve is sewn into the outer portion of the main arm loop defined by the strap. The sleeve is designed with a v-shaped front entryway to facilitate insertion of a smaller diameter flashlight into the sleeve. Larger diameter flashlights are strapped onto the forearm underneath the main loop.

With this scheme, any flashlight can be fastened to the body, irrespective of its diameter, and the flexible nature of the unit enables it to be compacted and stored anywhere, taking up no more space than a pair of socks.

DETAILED DESCRIPTION OF THE PREFERRED EMBODIMENT

Figure 1:
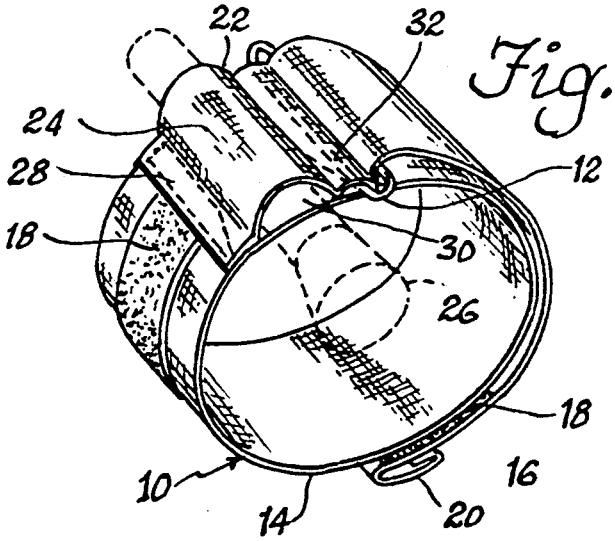
FIG. 1 is a perspective view of the invention as it would appear on a forearm, but without the forearm.
Figure 2:
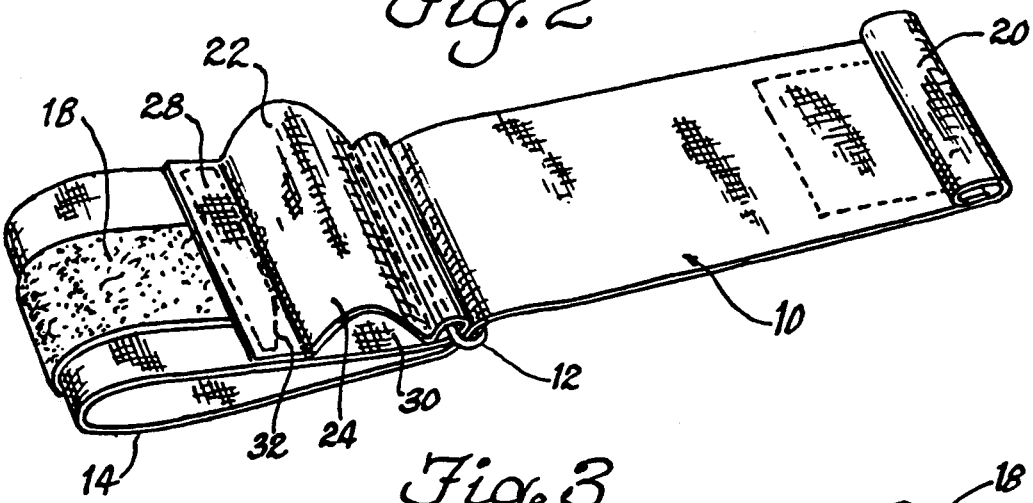
FIG. 2 is a perspective view of the invention as it would appear being tightened; and, FIG. 3 is a perspective view of the invention as seen from the underside of the orientation of FIG. 2.
Figure 3:
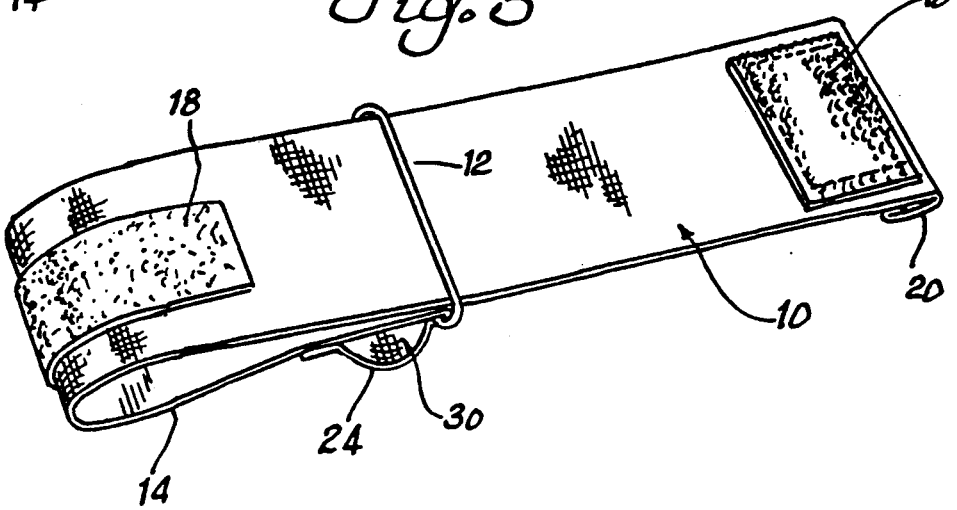

In its preferred form, the invention is basically fabricated from a single tough, relatively wide elastic strap 10. This strap has a slotted ring 12 stitched into itself to define one end of a strap loop 14, the other end of which passes through the ring 12 and with its distal end 16, folds back on itself. The distal end of the strap attaches back to a central portion of the strap used to define the loop 14 by means of hook-and-loop fastener material, otherwise known as Velcro®, indicated at 20. Naturally, the mating faces are made respectively of hooks and loops that characterize Velcro® material. The very tip of the distal end 16 is folded back on itself and sewn to define a finger grip 20 to facilitate ripping the distal end 16 of the strap free of its Velcro attachment and quickly releasing the loop 14 of the holder.

The other end of the strap which is sewn around the ring 12 continues, with a slack portion 22 puckered up to define a sleeve 24 for a flashlight 26, with the better end of the strap being sewn back to itself at 28. The interior channel 30 formed by the sleeve 24 seats a flashlight 26 of small diameter, generally no larger than an AA-cell flashlight. Insertion of the flashlight into the sleeve is facilitated by the v-shaped entry 32 into the sleeve channel.

Because the sleeve is dimensioned to accommodate a smaller diameter flashlight, a second sleeve of larger size could be added at another portion of the strap for a larger flashlight. However, it is relatively simple in the event that a large flashlight need be used to insert the flashlight inside the loop 14 so that the strap straps the C-cell or D-cell flashlight to the arm. Although a second sleeve similar to the sleeve 24 might appear somewhat more elegant, as a practical matter simply strapping the larger flashlight to the arm is more convenient.

In the event the slot-defining ring 12 is plastic or some other non-conductive material, the entire structure is non-conductive. However, even if it is metal, the radial extent of the ring is so slight that, coupled with the fact that it is largely covered by cloth, no great electrical threat is posed by a possibility of accidental contact of the device with live wiring. The invention is so adaptable in use to virtually any kind of flashlight, and is so compact when not in use by nature of its fabric construction and its relatively inexpensive construction made possible by the abundant supply of inexpensive but high-quality tough elastic fabrics makes the flashlight holder an ideal candidate for every handyman's tool box and the glove compartment of every car, as well as a good gift for Father's day, a birthday, or Christmas for the father who has just about everything.

It is hereby claimed:

1. An armband flashlight retainer comprising:

(a) an elastic loop dimensioned to encircle an arm;

(b) a sleeve attached to said loop to seat a flashlight therein;

(c) an elongated strap defining said loop, with said armband being adjustable to make the size of said loop adjustable;

(d) one end of said loop mounting a slotted ring and the other end of said loop being formed by said strap passing through said slotted ring and fastening back to itself;

(e) said loop fastening to itself with hook-and-loop fastener material; and (f) said strap defining said one end of said loop and continuing through said slotted ring and being sewn to itself to retain said slotted ring, and continuing beyond said ring to define said sleeve.

2. Structure according to claim 1 wherein said strap is a continuous swatch of elastic cloth defining said sleeve and said loop.

3. Structure according to claim 2 wherein the other end of said strap is doubled back onto itself and sewn to define a finger grip for quickly releasing said strap by separating same at the interface between said hook and loop fastener material.

4. Structure according to claim 2 wherein said cloth is a synthetic non-biodegradable cloth.

* * * * *